US008281698B2

(12) United States Patent
Haywood

(10) Patent No.: US 8,281,698 B2
(45) Date of Patent: Oct. 9, 2012

(54) RAPID FIRE WEAPON WITH BIDIRECTIONAL INTERCHANGABLE BARREL

(75) Inventor: Leroy E. Haywood, Eland, WI (US)

(73) Assignee: Leroy Edward Haywood

( * ) Notice: Subject to any disclaimer, the term of this patent is extended or adjusted under 35 U.S.C. 154(b) by 258 days.

(21) Appl. No.: 12/687,900

(22) Filed: Jan. 15, 2010

(65) Prior Publication Data

US 2011/0023694 A1 Feb. 3, 2011

Related U.S. Application Data

(60) Provisional application No. 61/144,827, filed on Jan. 15, 2009.

(51) Int. Cl.
*F41A 21/48* (2006.01)
*F41F 1/00* (2006.01)

(52) U.S. Cl. ..... 89/9; 89/14.2; 89/126; 89/128; 42/75.01; 42/76.01

(58) Field of Classification Search ..... 89/9–13.1, 89/14.05, 14.2, 14.3, 126, 128; 42/75.02, 42/76.01
See application file for complete search history.

(56) References Cited

U.S. PATENT DOCUMENTS

| | | | | |
|---|---|---|---|---|
| 2,550,280 | A * | 4/1951 | Martin et al. | 89/139 |
| 2,568,198 | A * | 9/1951 | Loomis et al. | 89/140 |
| 3,386,336 | A | 6/1968 | Roy | |
| 3,455,203 | A | 7/1969 | Pillersdorf | |
| 3,517,586 | A * | 6/1970 | Stoner | 89/198 |
| 3,791,256 | A * | 2/1974 | Curtis et al. | 89/185 |
| 4,358,986 | A * | 11/1982 | Giorgio | 89/142 |
| 4,505,182 | A * | 3/1985 | Sullivan | 89/132 |
| 4,519,156 | A * | 5/1985 | Shaw | 42/77 |
| 5,433,133 | A | 7/1995 | La France | |
| 5,883,328 | A * | 3/1999 | A'Costa | 89/14.2 |
| 5,900,577 | A * | 5/1999 | Robinson et al. | 89/191.01 |
| 6,497,065 | B1 | 12/2002 | Huston | |
| 6,604,314 | B2 | 8/2003 | Fluhr | |
| 6,837,139 | B2 | 1/2005 | Meyers | |
| 6,889,464 | B2 | 5/2005 | Degerness | |
| 7,302,774 | B2 | 12/2007 | Meyers | |
| 7,574,823 | B2 | 8/2009 | Makayama | |
| 7,644,528 | B2 | 1/2010 | Wossner et al. | |
| 7,726,058 | B2 * | 6/2010 | Richards | 42/51 |
| 2009/0282718 | A1 * | 11/2009 | Bartley | 42/75.03 |

* cited by examiner

*Primary Examiner* — Michael David

(57) ABSTRACT

An improved barrel and attachment system for rapid fire weapons having a quick release and replacement. Further the barrel is lighter than comparable barrels for the same purpose, and has a flash suppression system.

11 Claims, 7 Drawing Sheets

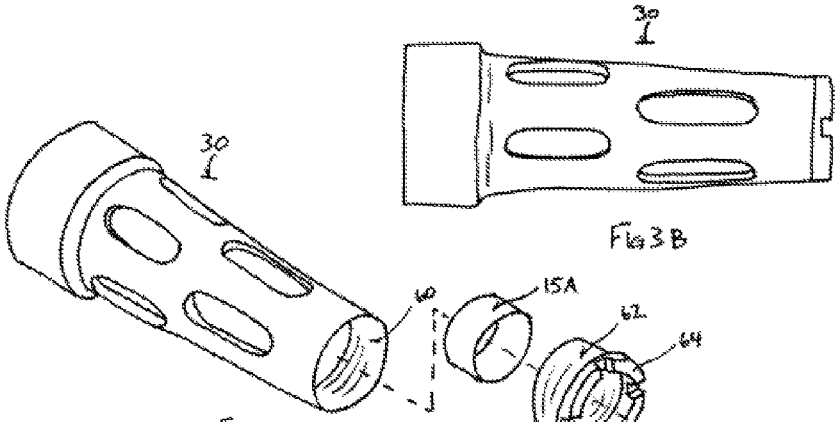
FIG 3B
FIG 3A
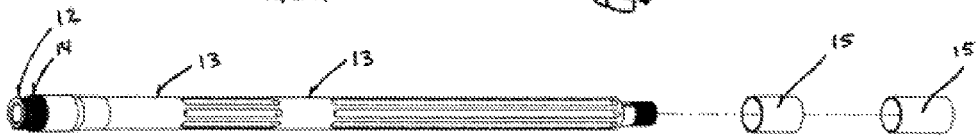
FIG 4A
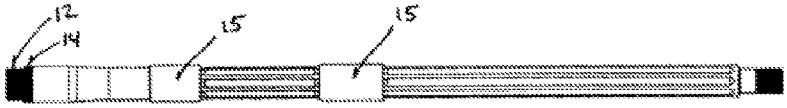
FIG 4B
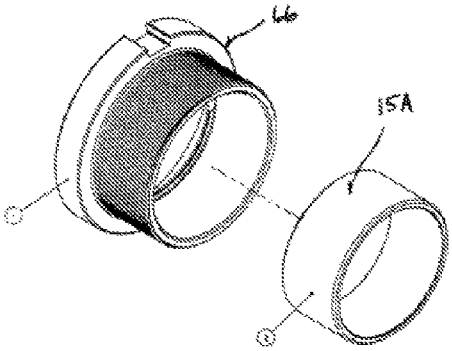
FIG 5A
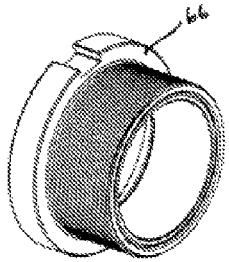
FIG 5B
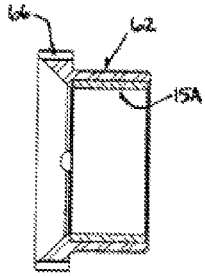
FIG 5C

RAPID FIRE WEAPON WITH BIDIRECTIONAL INTERCHANGABLE BARREL

BACKGROUND OF THE INVENTION

1. Field of the Invention

The present invention relates to improvements in the field of light weaponry, and directed more particularly to improvements in the barreling for 30 or 50 caliber rapid fire weapons having an interchangeable barrel, and requiring a low flash profile.

2. Description of the Related Art

The relevant art of interest describes various embodiments of the M2 class machine gun, typically used against infantry, unarmored or lightly armored vehicles, planes or boats, light fortifications and the like.

Since their invention by John Browning machine guns have operated principally as follows:

- The gunner pulling the bolt assembly/bolt carrier rearward by way of the cocking lever to the point bolt carrier which engages a sear and stays in this rear position until trigger is activated
- The trigger is activated making the bolt carrier move forward which
  - Loads a fresh round into chamber and locking bolt
  - And causing firing of the round by way of a firing pin or striker hitting the primer that ignites the powder when bolt reaches locked position,
- The recoil unlocking and removing the spent case from the chamber and ejecting it out of the weapon as the bolt is moving rearward
- A recoil spring loading the next round into the firing chamber.
- Usually the recoil spring aka main spring tension pushes bolt back into battery and a cam strips the new round from a feeding device, belt or box.

This cycle is repeated as long as the trigger is activated by the gunner. Releasing the trigger resets the trigger mechanism by engaging a sear so the weapon stops firing with bolt carrier fully at the rear.

The rate of firing of the weapon is largely a function of Newton's second law with the inertia of the recoil being largely a function of the weight of the barrel. Therefore in general, the lighter the barrel, the faster the recoil, and the higher number of rounds per minute can be fired.

The M2 has varying cyclic rates of fire, depending upon the model. For example the M2HB (heavy barrel) air-cooled ground gun having an approximately 85 lb barrel has a cyclic rate of 450-575 rounds per minute. The AN/M2 aircraft gun having a barrel weighing approximately 24 lbs has a cyclic rate of 750-850 rpm; this increases to 1,200 rpm or more for AN/M3 aircraft guns fitted with electric or mechanical feed boost mechanisms. These maximum rates of fire are generally not achieved in use, as sustained fire at that rate will wear out the bore within a few thousand rounds, necessitating replacement. The M2HB's sustained rate of fire is considered to be anything less than 400 rounds per minute.

Typically the M2 is mounted on a turret attached to a vehicle or an aircraft. The M2 can be water cooled, typically during ground applications, but many times when mounted in aircraft or light vehicles, water cooling can be cumbersome. This was compensated in air cooled versions by adding a heavy barrel which could weigh up to 85 lbs but is done to allow a larger surface area to increase heat dissipation. When extreme heating is caused during heavy use the barrels wear significantly and would need to be changed out more frequently, with a long procedure involving several individuals to get the weapon back into operation.

Therefore it is advantageous to have a light barrel with improved heat transfer characteristics.

A later version known as the Quick Change Barrel (QCB) was developed with a barrel weighing approximately 11-14 Kg, or 24-30 lbs. The QCB was designed to be removed from the front of the weapon having the barrel screwed or otherwise mounted to the internals of the weapon, including but not limited to, a barrel extension, buffer, and bolt. This was done by the gunner advancing to the front of the weapon releasing a lock, and unscrewing the barrel from the front of the weapon by hand or by use of some form of ratcheting tool. Some current applications of the M2 having the QCB are not suited for the barrel to be removed from the front of the weapon. One example being an M2 mounted to a HMVV with little room to maneuver to retract the weapon into the vehicle to gain a frontal approach to the barrel, causing exposure to the gunner should an attempt be made to change the barrel from outside the vehicle.

Therefore the QCB gave the advantage of taking less time and manpower to change the barrel but did so at the cost of exposing one to potential enemy fire.

Therefore it would be advantageous during such times to extract the barrel through the rear of the receiver (body) of the weapon, without necessitating an involved process and having sufficient maneuvering room to complete the barrel change in tight quarters.

Because the M2 was intentionally designed to be fit into many configurations, it can be adapted to feed from the left or right side of the weapon by exchanging the belt-holding pawls, the belt feed pawl, and the front and rear cartridge stops, then reversing the bolt switch. The conversion can be completed in under a minute with no tools. Therefore one skilled in the art will recognize various configurations for the present inventions depending upon the needs and requirements of the user.

SUMMARY OF THE INVENTION

Summary

The present invention relates to improvements to a QCB class of weapon having a light barrel with improved heat transfer characteristics, approximately 14 lbs—which is considerably lighter than previous 24 lbs barrels. This is important in aircraft type applications in addition to standard ground applications. Further, the improvements can be mounted on the front of the weapon by means of an indexible system eliminating the need for removing the barrel through the receiver body. It can typically be accomplished by one person. Further, the weapon having the new barrel design can be fired at approximately 1100 to 1200 rounds per minute in an aircraft type application. Typically 1150 rpm is achieved.

Further improvements reduce the barrel flash of the weapon being designed for extraction through the receiver body. Flash is the light emitted as the round exits the end of the barrel due to combusting gun powder. Barrel flash can impair or blind the gunner to targets, especially at night. It also provides an enemy with a visual contact in order to return fire. Flash is bad.

It is therefore an object of the invention to incorporate a system comprising an interchangeable barrel being connected with a rapid fire weapon.

It is another object of the invention to provide a barrel interchange having a bi-directional approach through either the front of the receiver, or through the body of the receiver.

It is another object of the invention to allow the exchange of a barrel to be facilitated by one person.

It is another object of the invention that a click ring having indexing to be provided for attaching the barrel to the front of the receiver.

It is another object of the invention to provide a barrel having substantially the same performance as a heavy barrel, yet weighing approximately 14 lbs.

It is another object of the invention that the weapon be able to fire at approximately greater than 1100 rounds per minute.

It is another object of the invention to provide a quick attach, quick release mechanism between a barrel and a receiver.

It is another object of the invention to reduce the barrel flash of a weapon.

These and other advantages of the present invention will become readily apparent upon review of the following specification and drawings.

BRIEF DESCRIPTION OF THE DRAWINGS

A complete understanding of the present invention may be obtained by reference to the accompanying drawings, when considered in conjunction with the subsequent, detailed description, in which:

FIG. 3A shows an exploded view of components of a barrel support structure with bushing;

FIG. 3B shows a side view of an assembled barrel support structure;

FIG. 4A shows an exploded view of one embodiment of a barrel with bushings;

FIG. 4B shows a side view of barrel from 4A with bushings attached;

FIGS. 5A, 5B and 5C show; an exploded, perspective, and cross sectional view of a threaded fitting with press-fit bushing;

DETAILED DESCRIPTION OF THE DRAWINGS

Figures 1A, 1B:
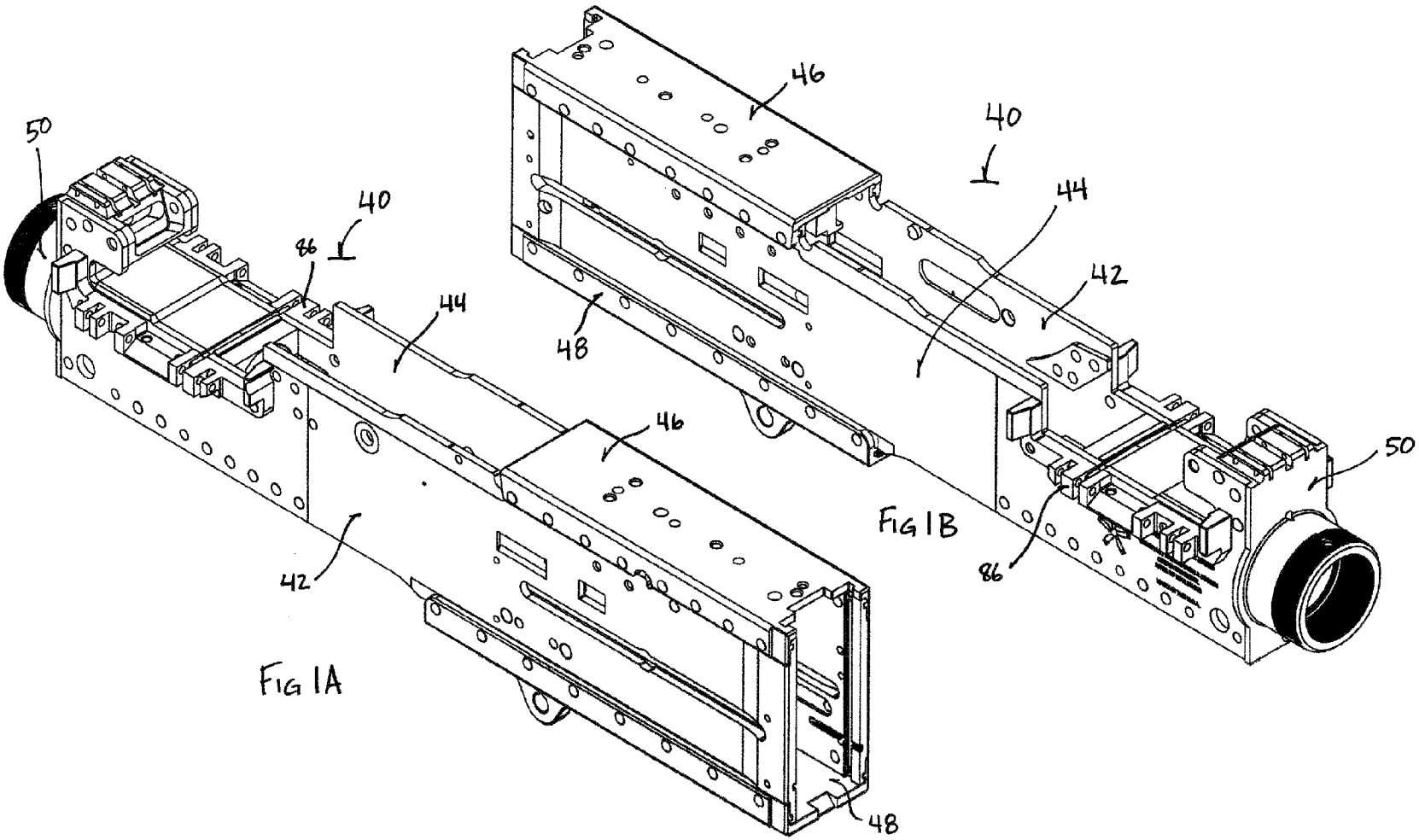
FIG. 1A shows a rear perspective view of a receiver housing.
FIG. 1B shows a front perspective view of a receiver housing.
Figure 2:
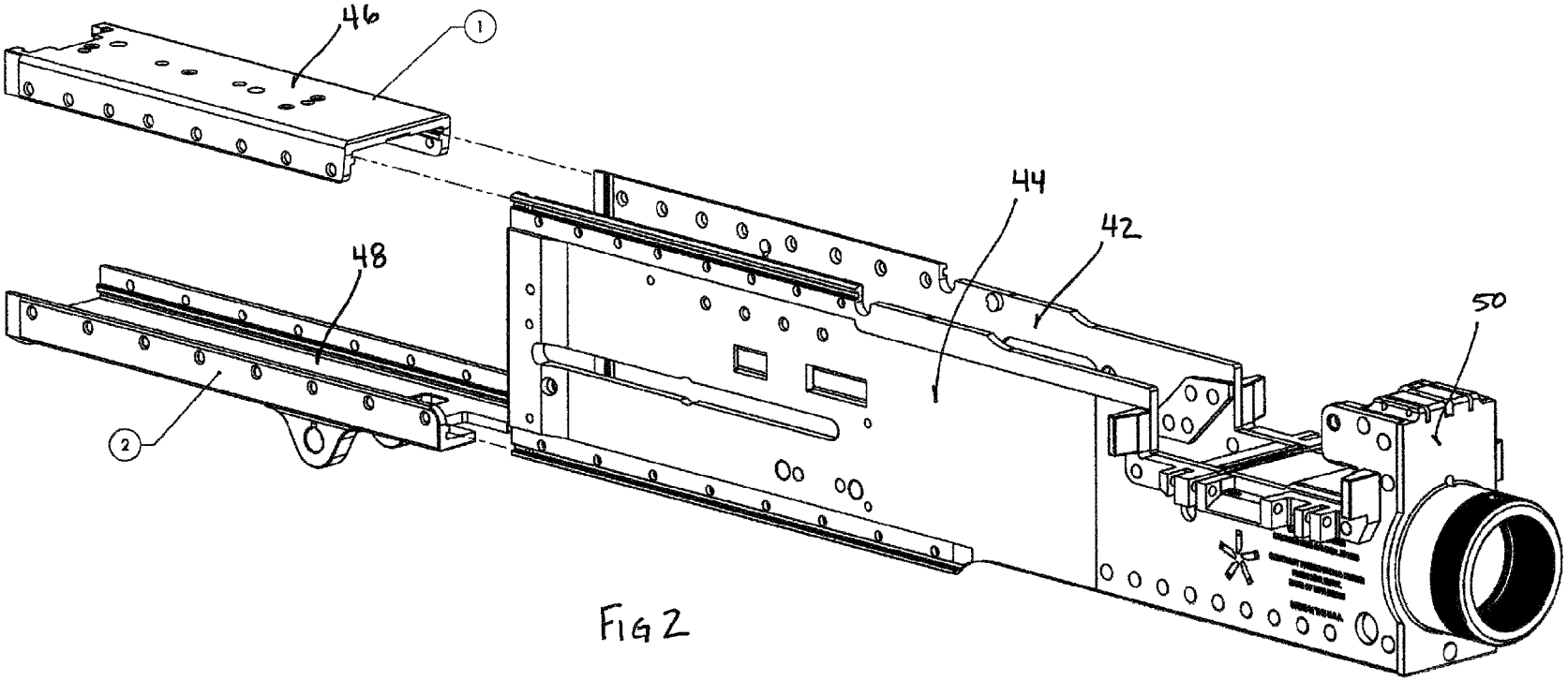
FIG. 2 shows a front exploded view of components of a receiver housing including left plate, right plate, top plate, bottom plate and front assembly.

A receiver housing (40), as seen in FIGS. 1 and 2, consists of the receiver assembly (not shown) which is also comprised of at least one side plate (42) also referred to as the left side plate and a second side plate (44) also referred to as a right side plate, however the side plates may be reversed depending upon the direction of feed of the munitions. Therefore actual locations of the various plates are reconfigurable and given as a reference. The receiver housing is also comprised of a top plate (46), a bottom plate (48), a front plate (50) and a back plate (not shown) the front plate (50) comprising an interface for the barrel support (30) which attaches to the front plate (50) and the barrel (10) which attaches to portions of the receiver assembly located in the interior of the receiver housing (40).

Some typical functions of the barrel support (30) as shown in FIG. 3 is to interface between the machine gun and a tripod or turret as required. In one embodiment of the present invention, the barrel support (30) is fitted with a front sizor (64) and a rear sizor (66), shown in FIG. 5. The sizors (64) and (66) are generally fitted with bushings (15A) being sized to properly interface with other bushings (15) mounted on the barrel (10). Thus providing a snug fit during firing, yet enabling the barrel (10) to slide through the various diameters of the barrel support (30) whether being removed from the front or rear of the weapon. In a preferred embodiment the outer diameter of the bushings (15) are sized to correspond with the chamber region (17), being the widest region of the barrel (10) as shown in FIG. 6. Various inside threading (60) and outside threading (62) schemes are used to facilitate attachment and replacement.

Figures 6A, 6B, 6C, 6D:
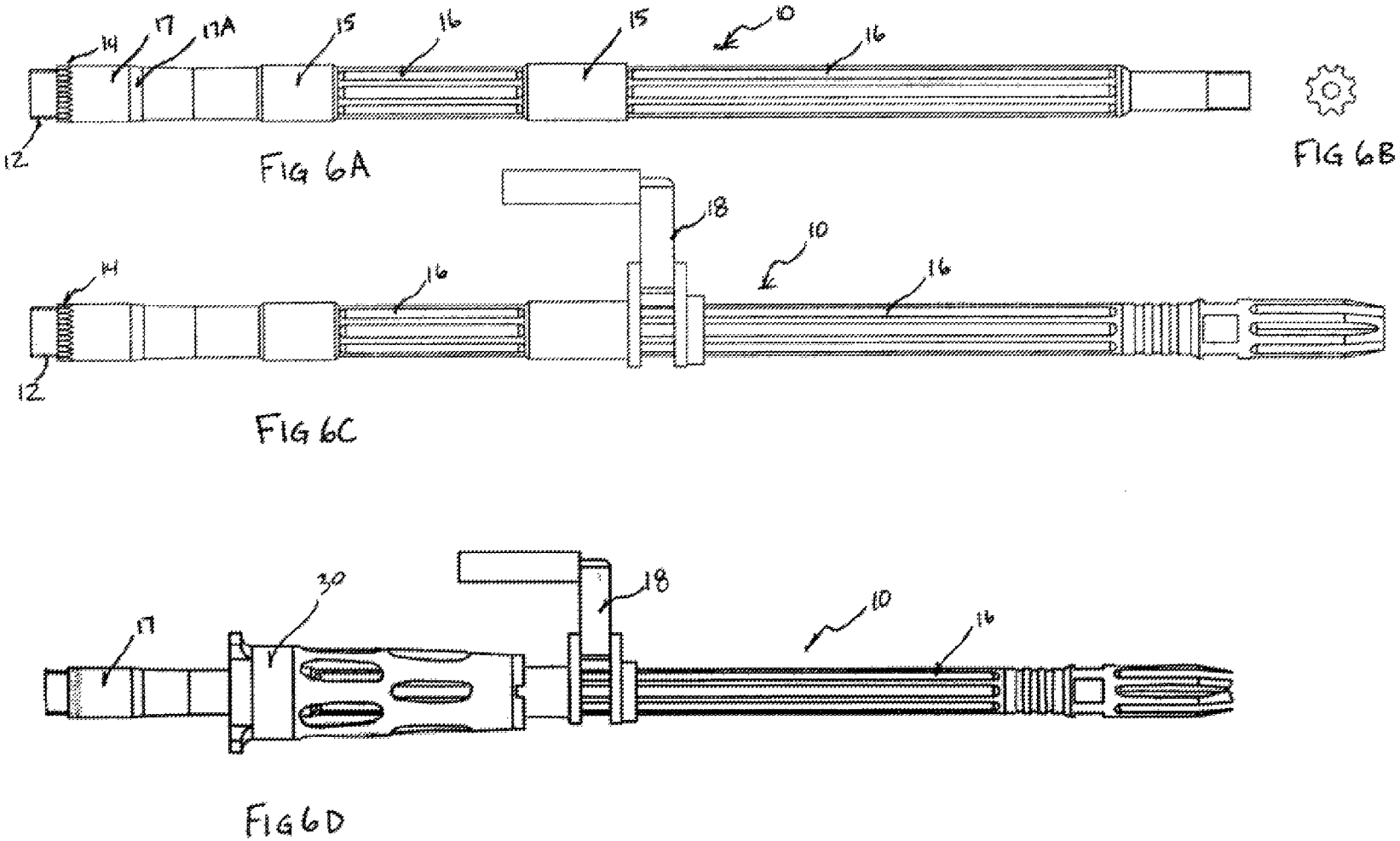
FIG. 6A shows a side view of one embodiment of a barrel.
FIG. 6B shows a cross sectional view highlighting flutting of the barrel sides.
FIG. 6C shows a side view of the embodiment of 6A having a flash suppressor attached with a ratcheting tool being engaged.
FIG. 6D shows a side view of the embodiment of 6C having a barrel support structure.

The barrel (10) comprises various barrel attachment (13) regions being substantially cannular in form with other portions having fluting (16) shown in FIG. 6 with a cross section of one embodiment shown in FIG. 6B. Such fluting provides sufficient rigidity of the barrel (10) over the length, while decreasing weight, which results in faster recoil and firing rates. Further, fluting increases barrel surface area which increases cooling, also leading to longer life of the barrel (10).

FIGS. 7 through 12 provide enablement for a locking mechanism, generally used in conjunction with quick change barrel type embodiments providing a means for removing the barrel through the front plate assembly (50) (front of the gun), or through the receiver assembly (40) (rear of the gun) from a common starting point.

Figure 7:
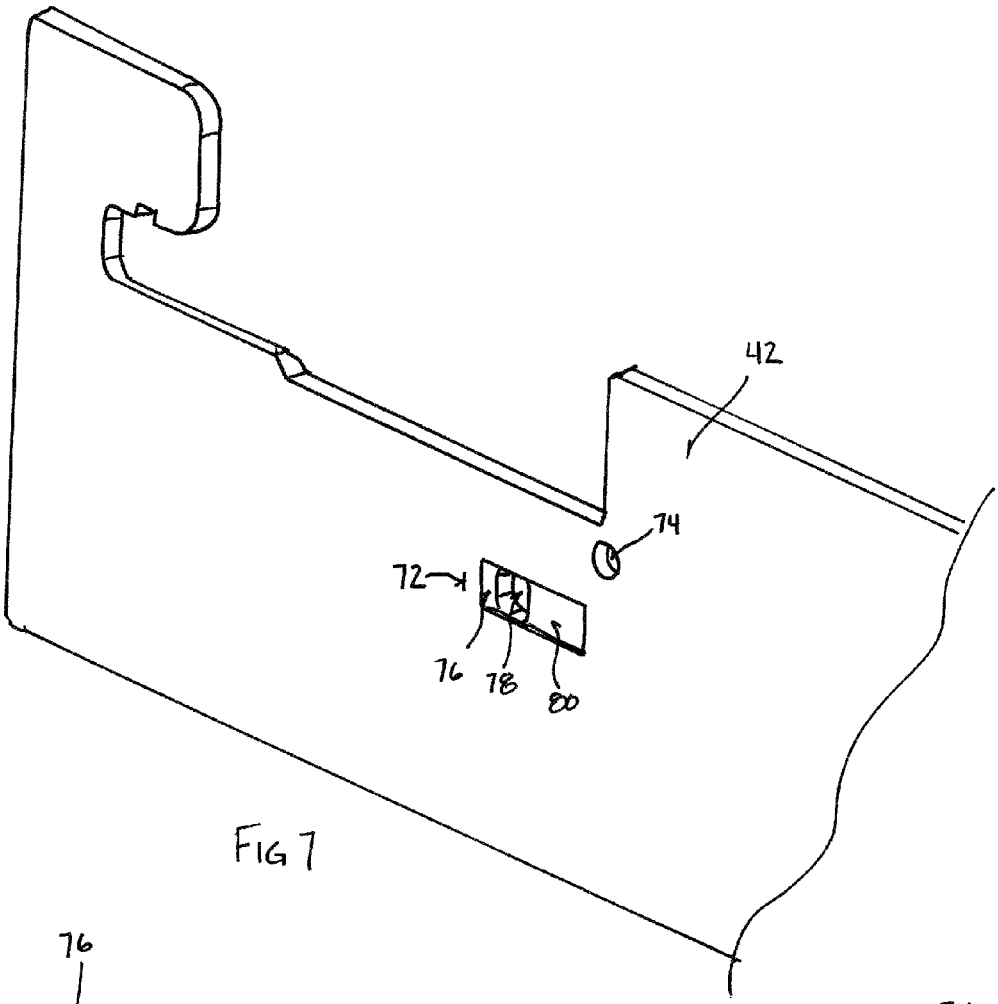
FIG. 7 shows a perspective view of the inside of a side plate having a tapered recess.
Figure 8:
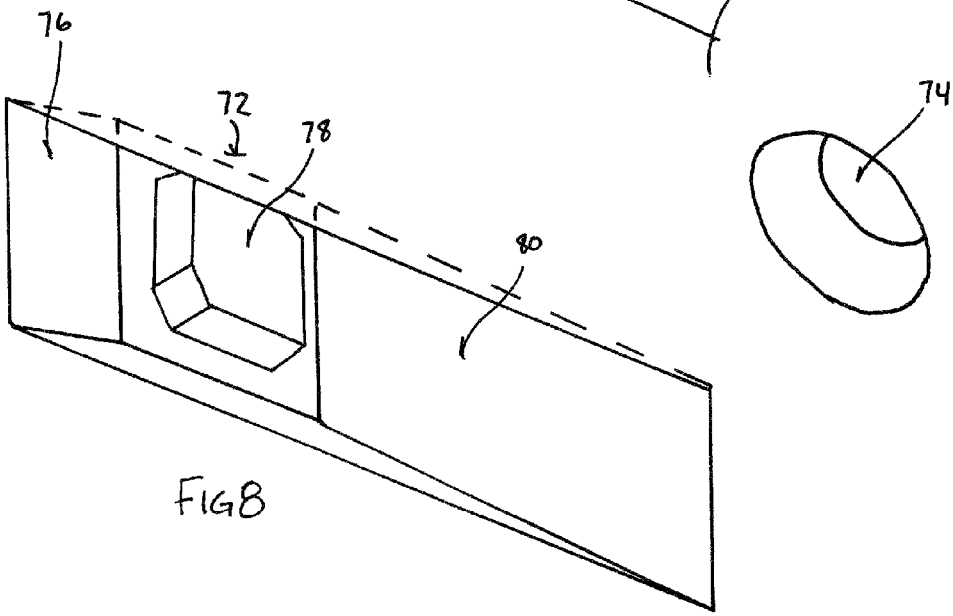
FIG. 8 shows a detail perspective view of the recess of FIG. 7.

FIGS. 7 and 8 show a tapered relief (72) being formed in the inside portion of a side plate (42) or (44) as required. In this instance the tapered relief (72) is formed in a first side plate (42). A reference hole (74), as it is used for other purposes but provides a handy reference point, is shown through several of the Figures. As shown in FIG. 8, the tapered relief (72) in this embodiment is formed part way through the wall of the side plate (42). It is recommended, but not required, that the tapered relief (72) generally comprises a fore region (76) having a steeper approach than the aft region (80) which will be apparent upon further discussion.

Figure 9:
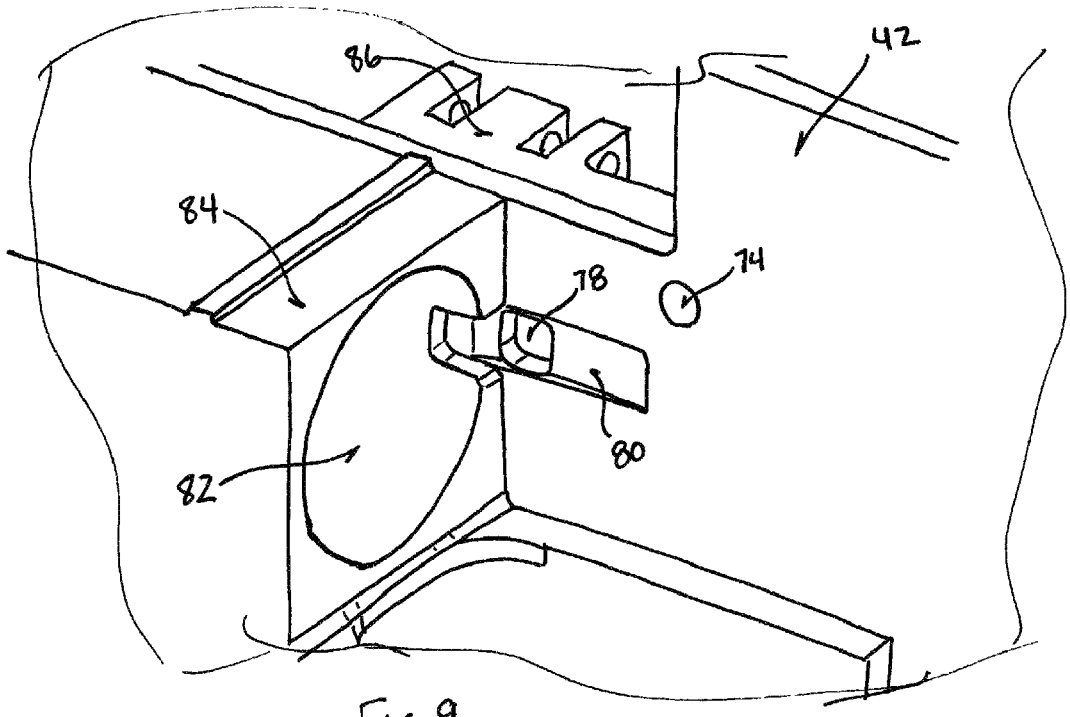
FIG. 9 shows a partial exploded view of a tapered recess being in assembly with a barrel extension.

FIG. 9 shows a position for a round chamber (82) as a reference and a barrel extension (84) having threading which interfaces with a barrel (10). Miscellaneous hardware (86)

can be seen mounted on the outside of face of the side plate (42) which is also delineated in FIG. 1 for reference.

Figure 10:
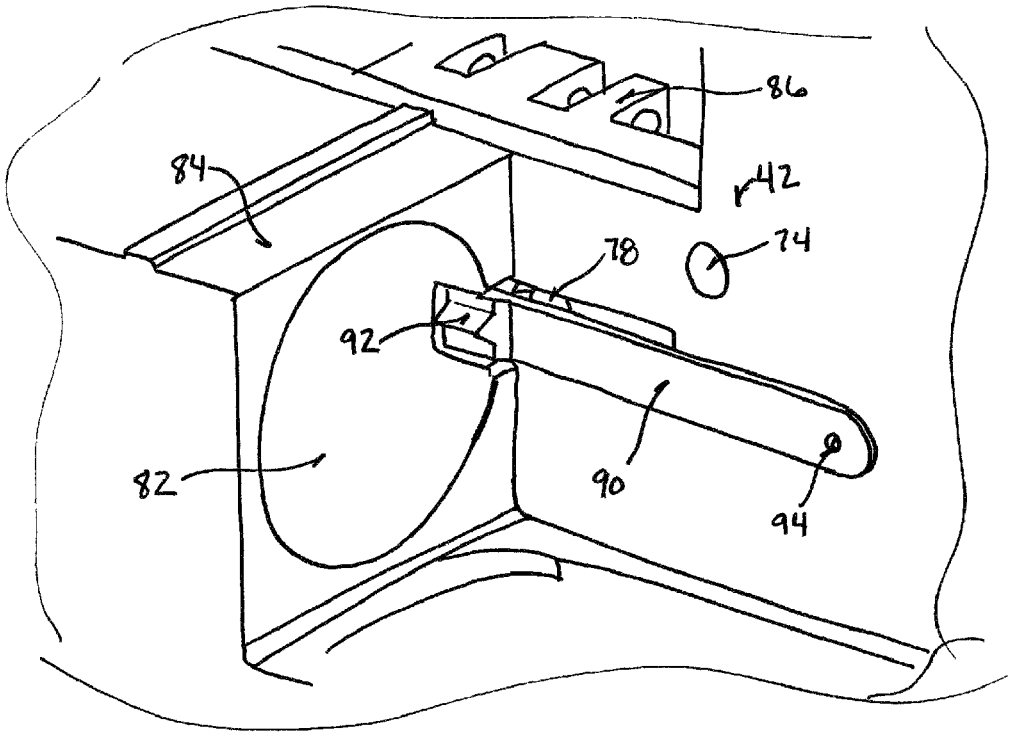
FIG. 10 shows the assembly of FIG. 9 with a lock assembly in an engaged position.

FIG. 10 shows the assembly of FIG. 9 also having a lock assembly (90) shown positioned in proximity for reference. In use, the lock assembly (90) would be attached to portions of the receiver assembly (83) by means of a fastener, such as a pin (94) and travel linearly with the assembly (83). It may be noted that the lock assembly (90) body may act as a leaf spring allowing movement of the spline (92) when the spline is located substantially with the tapered relief (72). In this embodiment, the spline is formed keyways with the inverse of the shape of the locking detents (14), and may take the form of a; scallop, facet, groove, furrow, flute, or the like.

Figure 11A:
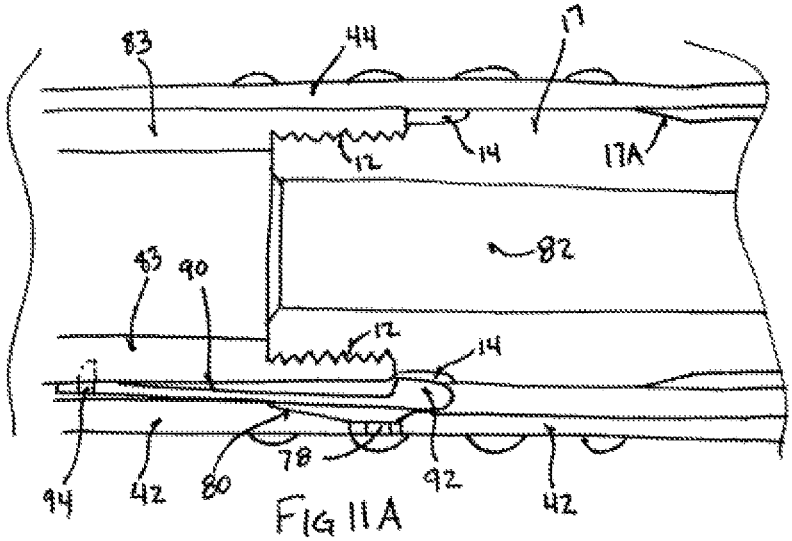
FIG. 11A shows a schematic representation of a barrel with firing chamber, barrel extension, lock assembly and tapered recess in a locked and firing position.

FIG. 11A shows a representation of a configuration generally associated with firing of the weapon. As the weapon is fired from the round chamber (82), without constraint the threads (12) have a tendency to loosen due to vibration. With the spline (92) being located just beyond the fore region (76) of the tapered relief (72) it is impinged between the chamber region (17) and the side plate (42) which causes it to engage with a portion of the locking detents (14) and keeping it from rotating the barrel (10) loose from the receiver assembly (83).

Figure 11B:
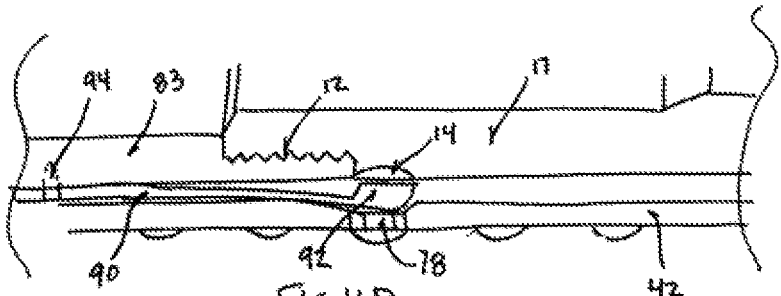
FIG. 11B shows a schematic representation of the bottom portion of FIG. 11A in a released position suited toward removing the barrel from the front of the weapon.

Should the gunner require to utilize the quick change barrel option from the front of the weapon, as shown in FIG. 11B, the receiver assembly (83) in connection by means of the pin (94) with the lock assembly (90) is positioned relative to the tapered relief (72) such that the spline (92) is no longer impinged, thus allowing the barrel (10) to be twisted, turned, wrenched, or rotated freely to remove the barrel. To aid in the spring action of the lock assembly (90) and spline (92), the aft region (80) can be elongated to facilitate bending. Further a viewing port (78) can be provided to provide the gunner visual feedback regarding the position of the spline (92). Visual indices can be added to the outside of the spline (92) to aid in visual feedback.

Figure 11C:
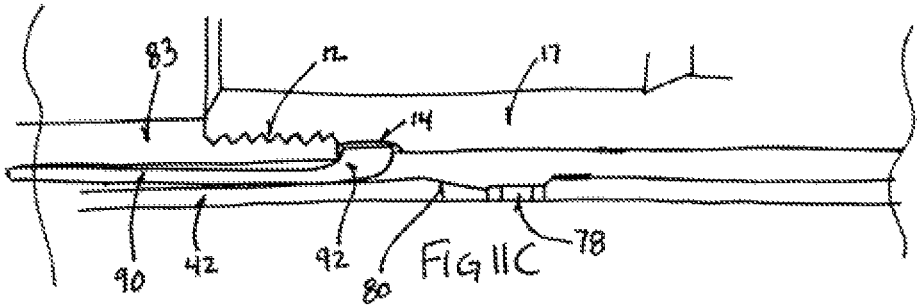
FIG. 11C shows a schematic representation of the bottom portion of FIG. 11A in a position suited toward removing the barrel from the rear of the weapon.
Figure 12:
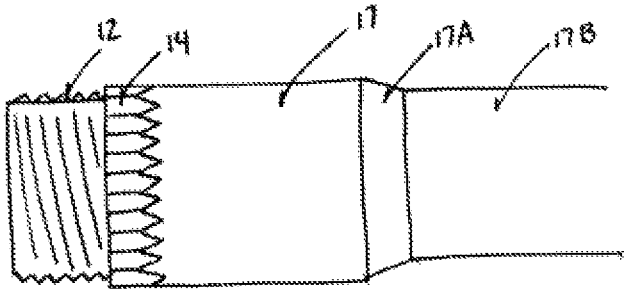
FIG. 12 shows a perspective view of the breech of the barrel highlighting one embodiment of the locking detents feature.

In order to remove the barrel through the rear of the receiver housing (40), any ratcheting tool (18) should be removed from the barrel (10) and the back plate should be removed and the assembly prepared for removal. In this situation, as shown in FIG. 11C, the entire assembly having the barrel (10) attached is pulled rearward with the spline (92) remaining in the impinged position as it slides along the side plate beyond the aft region (80) of the tapered relief (72).

CONCLUSION, RAMIFICATIONS, AND SCOPE

Although the present invention has been described, those skilled in the art will understand that various changes, substitutions, and alterations herein may be made without departing from the spirit and scope of the invention in its broadest form.

Having thus described the invention, what is desired to be protected by Letters Patent is presented in the subsequently appended claims.

What is claimed is:

1. A bi-directional barrel interchange system for a rapid fire weapon adapted for quickly and easily removing or attaching a barrel with a receiver assembly from either the front or alternatively from the back end of the receiver housing comprising;

a receiver assembly comprising a receiver housing having at least one side plate, a top plate, a bottom plate, and a back plate;

said receiver housing having at least one tapered relief on at least one of the side plate, the top plate, or the bottom plate;

the receiver assembly further comprising a barrel extension;

said barrel extension comprising threads suited for receiving the barrel assembly;

a barrel assembly comprising an attaching region comprising a first portion having threads and a second portion having at least one locking detent;

a lock assembly comprising a spline, said spline being substantially mated keyway with at least one of said locking detents;

said spline also being in communication with a spring mechanism said spring mechanism being in attachment with said barrel extension;

removal of said barrel assembly from said receiver assembly comprising;

moving the spline to a predetermined position in alignment with the tapered relief;

unscrewing the barrel assembly from the barrel extension and removing from the front of the receiver housing;

or in the alternative;

removing the back plate from the receiver housing;

removing the receiver assembly, having the barrel assembly attached, through the back of the receiver housing.

2. The system in accordance with claim 1: wherein said tapered relief further comprises a locating hole.

3. The system in accordance with claim 2: wherein the location of the locating hole is coordinated with the spline such that when the spline is located substantially within the locating hole, the locking mechanism is disengaged.

4. The system in accordance with claim 1: wherein the spline is marked with a visual indicia.

5. The system in accordance with claim 1: wherein the barrel further comprises fluting.

6. The system in accordance with claim 5: wherein the barrel is coupled with at least one bushing.

7. The system in accordance with claim 6 wherein the bushing is movably coupled with a barrel support.

8. The system in accordance with claim 7 wherein the barrel support further comprises at least one bushing being sized in coordination with the bushing of the barrel sufficient to support the barrel yet allow ease in removal of the barrel.

9. The system in accordance with claim 1, wherein the barrel is joined with a ratcheting tool.

10. The system in accordance with claim 1, wherein the system further comprises a flash suppressor.

11. The system in accordance with claim 10, wherein the flash suppressor diameter is sized in relation to cannulate with the smallest inner diameter of the bushing or receiver diameter.

* * * * *